US009022502B2

(12) United States Patent
Shoji

(10) Patent No.: US 9,022,502 B2
(45) Date of Patent: May 5, 2015

(54) PRINTING APPARATUS AND PRINT CONTROL METHOD

(71) Applicant: Canon Kabushiki Kaisha, Tokyo (JP)

(72) Inventor: Michiharu Shoji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/080,089

(22) Filed: Nov. 14, 2013

(65) Prior Publication Data

US 2014/0168305 A1 Jun. 19, 2014

(30) Foreign Application Priority Data

Dec. 18, 2012 (JP) ..... 2012-276116

(51) Int. Cl.
*B41J 2/045* (2006.01)
*B41J 29/38* (2006.01)

(52) U.S. Cl.
CPC ..... *B41J 2/04503* (2013.01); *B41J 2/0458* (2013.01)

(58) Field of Classification Search
CPC .. B41J 2/04503; B41J 2/0458; B41J 2/04563; B41J 29/393; B41J 2/04591; B41J 2/04581
See application file for complete search history.

(56) References Cited

U.S. PATENT DOCUMENTS

| | | | | |
|---|---|---|---|---|
| 6,419,338 | B1 * | 7/2002 | Ikeda | 347/14 |
| 6,515,445 | B2 | 2/2003 | Shoji et al. | |
| 6,599,043 | B2 | 7/2003 | Kobayashi et al. | |
| 6,712,440 | B2 | 3/2004 | Shoji | |
| 6,823,132 | B2 | 11/2004 | Saito et al. | |
| 6,838,855 | B2 | 1/2005 | Kobayashi et al. | |
| 6,853,161 | B2 | 2/2005 | Kobayashi et al. | |
| 6,910,752 | B2 | 6/2005 | Shoji | |
| 7,036,902 | B2 | 5/2006 | Shoji | |
| 7,078,875 | B2 | 7/2006 | Shoji et al. | |
| 7,176,649 | B2 | 2/2007 | Shoji et al. | |
| 7,284,810 | B2 * | 10/2007 | Igarashi | 347/14 |
| 7,712,857 | B2 * | 5/2010 | Igarashi | 347/14 |

FOREIGN PATENT DOCUMENTS

JP 2005-041028 A 2/2005

* cited by examiner

*Primary Examiner* — Manish S Shah
*Assistant Examiner* — Jeremy Delozier
(74) *Attorney, Agent, or Firm* — Fitzpatrick, Cella, Harper & Scinto

(57) ABSTRACT

An embodiment of this invention is directed to ink droplet landing correction by a carriage scanning velocity. According to the embodiment, upon updating a correction value only in a case where a velocity difference is equal to or more than a predetermined value, possibility that ideal correction is not executed in an acceleration/deceleration region, and unnecessary correction occurs in a constant velocity moving region is reduced. More specifically, two velocity thresholds are set so as to sandwich a predetermined velocity of a servo profile. When the carriage scanning velocity falls in the range between the velocity thresholds, updating the correction value of the landing correction function is suppressed.

14 Claims, 10 Drawing Sheets

E= 1/(ENCODER RESOLUTION) =1/150dpi
Tp : TIME TO PASS E AT CURRENT VELOCITY
Tref : TIME TO PASS E AT REFERENCE VELOCITY
Td : TIME NECESSARY FOR DROPLET TO PASS DISTANCE d TO PAPER AT VELOCITY Vd
Tdelay : LANDING CORRECTION DELAY A=Td/Tref
Tdelay=(Tp-Tref)*A

PRINTING APPARATUS AND PRINT CONTROL METHOD

BACKGROUND OF THE INVENTION

1. Field of the Invention

The present invention relates to a printing apparatus and a print control method, particularly to, for example, a printing apparatus that causes an inkjet printhead to discharge ink droplets to a print medium to print an image and a print control method thereof.

2. Description of the Related Art

An ink droplet discharged from a printhead mounted in an inkjet printing apparatus (to be referred to as a printing apparatus hereinafter) flies in the direction of the resultant vector of the velocity of a carriage that reciprocally scans the printhead and the discharged velocity of the ink. For this reason, if the carriage velocity varies, the landing position of the ink droplet on a print medium shifts, resulting in lower print quality. To prevent this, there is conventionally proposed a technique of adjusting the print timing in accordance with the carriage velocity to improve the ink droplet landing accuracy, thereby improving the image quality.

In a system in which servo velocity control of the carriage velocity is very stable, the image quality is improved by print timing adjustment in a region of the acceleration/deceleration range where the change in the velocity is large. On the other hand, in a constant velocity region, the ink droplet landing accuracy is sometimes improved by suppressing execution of the above-described print timing adjustment. Velocity information used to calculate the shift amount of the print timing is discrete acquired information including quantization errors detected from an encoder signal. Hence, in a case where the carriage velocity is stable, the error factor causes deterioration of the landing accuracy.

To solve this, a method is proposed in which print timing adjustment is executed only when the change in the carriage velocity is larger than a predetermined value. According to this method, control is performed not to automatically execute print timing adjustment in the constant velocity region where the carriage velocity is stable, thereby preventing deterioration of the landing accuracy.

For example, Japanese Patent Laid-Open No. 2005-041028 discloses an arrangement of a related art.

FIG. 11 is a graph for explaining a velocity information acquisition state during carriage acceleration.

Referring to FIG. 11, the ordinate represents a carriage velocity (V), and the abscissa represents a position (X) of the carriage on which the printhead is mounted. The position X is expressed by the distance from the home position of the carriage. A broken line 803 indicates an ideal velocity profile, and • indicates an actual velocity detected at a velocity detection timing ★.

Velocity information detected from a digital signal output from an encoder is obtained every time the carriage moves by a predetermined distance. Hence, the velocity detection timing ★ is obtained at an equal interval with respect to the carriage position. The torque of the carriage motor is adjusted by servo control such that the carriage velocity becomes close to the ideal velocity profile 803.

The actual velocity is shifted from the ideal profile because of a factor such as the state of a load that acts on the carriage driving mechanism. For this reason, in the conventional control method that executes print timing adjustment only when the change in the carriage velocity is larger than a predetermined value, adjustment is executed at timings (A, B, D, F, and G in FIG. 11) at which the velocity difference is larger than a velocity change amount δV to execute the adjustment. To the contrary, adjustment may be not executed at timings (C and E in FIG. 11) at which the velocity difference is small.

Hence, in the conventional method, if the velocity difference is small, print timing adjustment may be not executed, although it is ideal that the adjustment should be executed at each velocity detection timing because the velocity indeed changes during carriage acceleration/deceleration. On the other hand, in the constant velocity region of the carriage movement, print timing adjustment may be executed when a velocity difference of certain level is generated, although satisfactory printing can be performed without executing the print timing adjustment.

SUMMARY OF THE INVENTION

Accordingly, the present invention is conceived as a response to the above-described disadvantages of the conventional art.

For example, a printing apparatus and a print control method according to this invention are capable of performing satisfactory printing by appropriately executing or suppressing print timing adjustment when performing printing by scanning a carriage on which a printhead is mounted.

According to one aspect of the present invention, there is provided a printing apparatus that discharges ink from a printhead to a print medium while scanning a carriage on which the printhead is mounted. The apparatus comprises: a detection unit configured to detect a scanning velocity of the carriage; and an adjustment unit configured to adjust a print timing by the printhead based on the scanning velocity and a distance between the printhead and the print medium, wherein the adjustment unit suppresses adjustment of the print timing in a case where the scanning velocity detected by the detection unit falls within a predetermined range.

According to another aspect of the present invention, there is provided a print control method of discharging ink from a printhead to a print medium while scanning a carriage on which the printhead is mounted. The method comprises: detecting a scanning velocity of the carriage; and adjusting a print timing by the printhead based on the scanning velocity and a distance between the printhead and the print medium, wherein adjustment of the print timing is suppressed in a case where the detected scanning velocity falls within a predetermined range.

The invention is particularly advantageous since optimum print timing adjustment can indeed be executed in a region where the change in the scanning velocity of the carriage on which the printhead is mounted is large, and the print timing adjustment can be suppressed in a region where the stability of the scanning velocity is high. This makes it possible to prevent deterioration of the ink landing accuracy caused by a print timing calculation error or the like and realize high-quality printing.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" generically means an ink orifice or a liquid channel communicating with it, and an element for generating energy used to discharge ink, unless otherwise specified.

<Explanation of Inkjet Printing Apparatus (FIGS. 1 and 2)>

Figure 1:
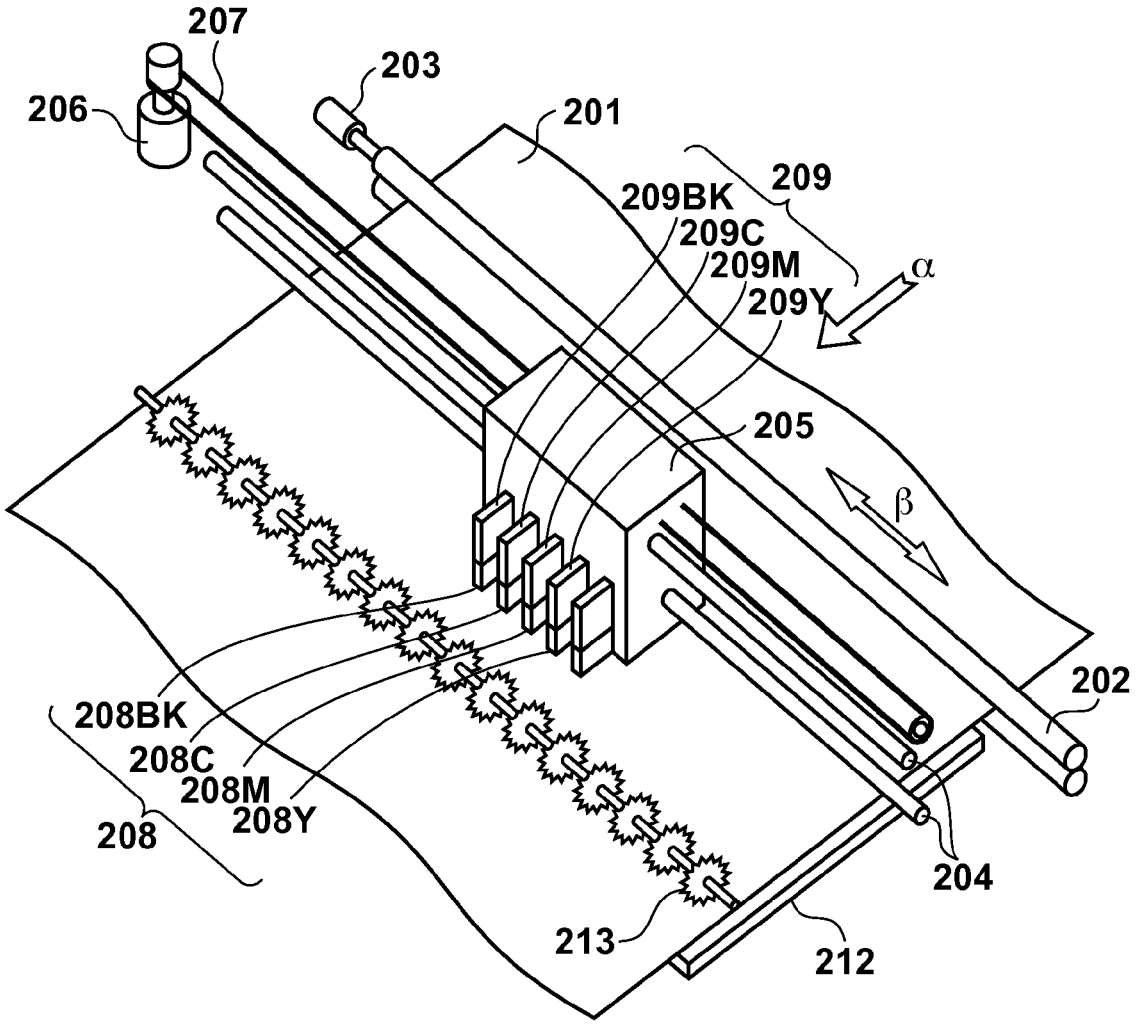
FIG. 1 is a perspective view showing the outline of the arrangement of a printing apparatus according to an exemplary embodiment.

FIG. 1 is a perspective view showing the main part of an inkjet printing apparatus according to an exemplary embodiment of the present invention.

Referring to FIG. 1, a printing medium 201 such as printing paper is supported by conveyance rollers 202 of the print medium arranged in the print region, ribs on a platen 212, and spurs 213, and conveyed in the direction (sub-scanning direction) of an arrow α as the conveyance rollers 202 are driven by a conveyance motor 203. Note that a stepping motor or a DC motor is used as the conveyance motor 203. In recent years, a DC motor is often used because of its quietness and the like.

In a case where a DC motor is used as the conveyance motor, a rotary encoder (not shown) is provided on the conveyance roller 202, and drive of the conveyance motor 203 is controlled based on an encoder signal obtained from the encoder.

Shafts 204 are provided parallel to and in front of the conveyance rollers 202. A carriage 205 is movably guided by the shafts 204 and reciprocally moved in the direction (main scanning direction) of an arrow β via a belt 207 by an output from a carriage motor 206. Lubricating oil such as grease is applied between the shafts 204 and the carriage 205 to reduce mechanical loads generated by friction and the like. Note that a stepping motor or a DC motor is used as the carriage motor 206, like the conveyance motor 203. In recent years, a DC motor is often used because of its quietness and the like.

In a case where a DC motor is used as the carriage motor, a linear encoder (not shown) is provided on the carriage 205, and a linear scale (not shown) is provided in parallel to the shafts 204. Drive of the carriage motor 206 is controlled based on a signal obtained from the linear encoder. In addition, a print timing to discharge ink from a printhead 208 is also generated based on the signal obtained from the linear encoder.

The printhead 208 and tanks 209 that contain inks are mounted on the carriage 205. The printhead shown in FIG. 1 is a printhead for color image print. For this reason, a head 208BK for discharging black ink, a head 208C for discharging cyan ink, a head 208M for discharging magenta ink, and a head 208Y for discharging yellow ink are arranged along the moving direction of the carriage 205. As the tanks 209, a tank 209BK for black ink (BK), a tank 209C for cyan ink (C), a tank 209M for magenta ink (M), and a tank 209Y for yellow ink (Y) are mounted and supply the inks to the heads corresponding to the respective colors.

The front surface (ink discharge surface) of the printhead 208, that is, the surface facing the print surface of the printing medium 201 at a predetermined interval (for example, 0.8 mm) is provided with an ink discharge portion. In the ink discharge portion, a plurality of (for example, 48 or 64) orifices are vertically arranged in line along a direction crossing the scanning direction of the carriage 205.

A controller including control circuits (CPU and ASIC) of the printing apparatus (to be described later) and a ROM and a RAM provided together receives, for example, print mode information and image data from an external host apparatus via an interface. The controller of the printing apparatus controls the printhead 208 via a head driver together with driving sources such as various kinds of motors in the printing apparatus based on the information and image data. The printhead 208 thus discharges the inks from the ink discharge portion and prints an image on the printing medium 201. That is, an operation of discharging the inks from the ink discharge portion and an operation of conveying the printing medium 201 in the sub-scanning direction by a predetermined amount are alternately repeated while moving the printhead 208 in the main scanning direction, thereby printing an image on the printing medium 201.

Figure 2:
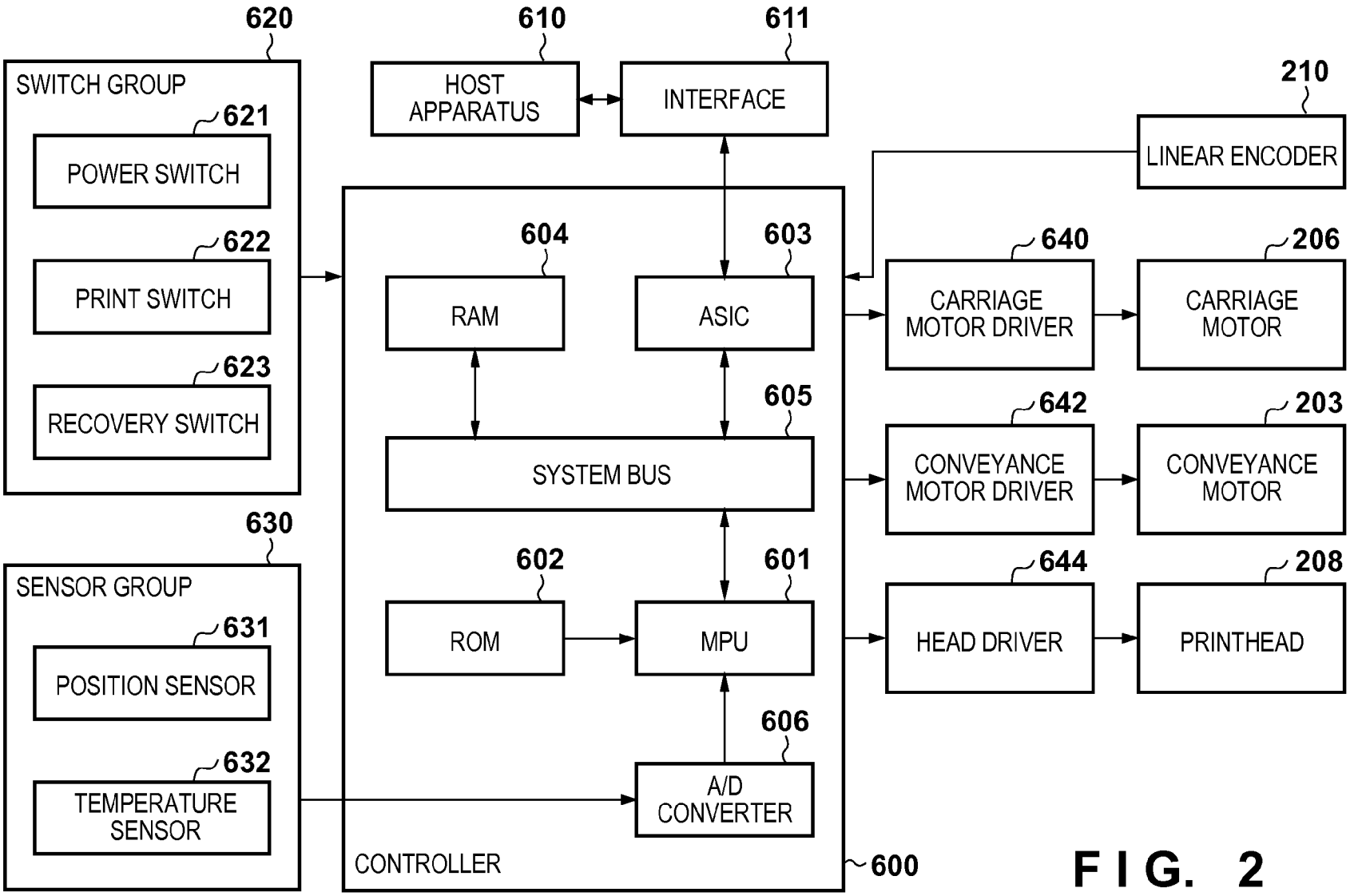
FIG. 2 is a block diagram showing the control arrangement of the printing apparatus shown in FIG. 1.

FIG. 2 is a block diagram showing the control arrangement of the printing apparatus shown in FIG. 1.

As shown in FIG. 2, a controller 600 includes an MPU 601, a ROM 602, an application specific integrated circuit (ASIC) 603, a RAM 604, a system bus 605, and an A/D converter 606. The ROM 602 stores programs corresponding to control sequences to be described later, necessary tables, and other fixed data. The ASIC 603 generates control signals to control the carriage motor 206, the conveyance motor 203, a linear encoder 210, and the printhead 208. The RAM 604 is used as an area to bitmap image data or a work area to execute the programs. The system bus 605 connects the MPU 601, the ASIC 603, and the RAM 604 to each other and exchanges data. The A/D converter 606 receives an analog signal from a sensor group to be described below, A/D-converts it, and supplies the digital signal to the MPU 601.

Referring to FIG. 2, a computer 610 (or a scanner for image reading or a digital camera) serves as an image data supply source and will be generically referred to as a host apparatus. The host apparatus 610 transmits/receives image data, commands, status signals, and the like to/from the printing apparatus via an interface (I/F) 611.

A switch group 620 includes a power switch 621, a print switch 622, and a recovery switch 623. A sensor group 630 configured to detect an apparatus state includes a position sensor 631 and a temperature sensor 632.

A carriage motor driver 640 drives the carriage motor 206 to reciprocally scan the carriage 205 in the direction of the arrow β. A conveyance motor driver 642 drives the conveyance motor 203 to convey the printing medium 201. A head driver 644 drives and controls the printhead 208.

The ASIC 603 transfers, to the printhead, data to drive printing elements (heaters for discharge) while directly accessing the storage area of the RAM 604 upon print scanning by the printhead 208.

As described above, a linear scale is provided in the moving direction of the carriage, and the linear encoder 210 is provided on the carriage 205. As the carriage 205 moves, the linear encoder 210 reads slits provided on the linear scale at an equal interval, generates an encoder signal, and outputs it to the ASIC 603.

With the arrangement shown in FIGS. 1 and 2, image data transferred from the host apparatus 610 is received by the interface 611 and sent to the controller 600. The controller 600 performs decompression of compressed data, conversion of a data sequence, and the like to convert the received data into a format printable by the printhead 208, and transfers it to the head driver 644.

Note that the printhead 208 shown in FIGS. 1 and 2 is, for example, an inkjet printhead of a type of discharging ink using thermal energy. The inkjet printhead causes film boiling of ink in an ink channel by thermal energy generated by an electrothermal transducer provided in the ink channel, and discharges the ink droplets from the ink orifice by the foaming energy.

Figure 3:
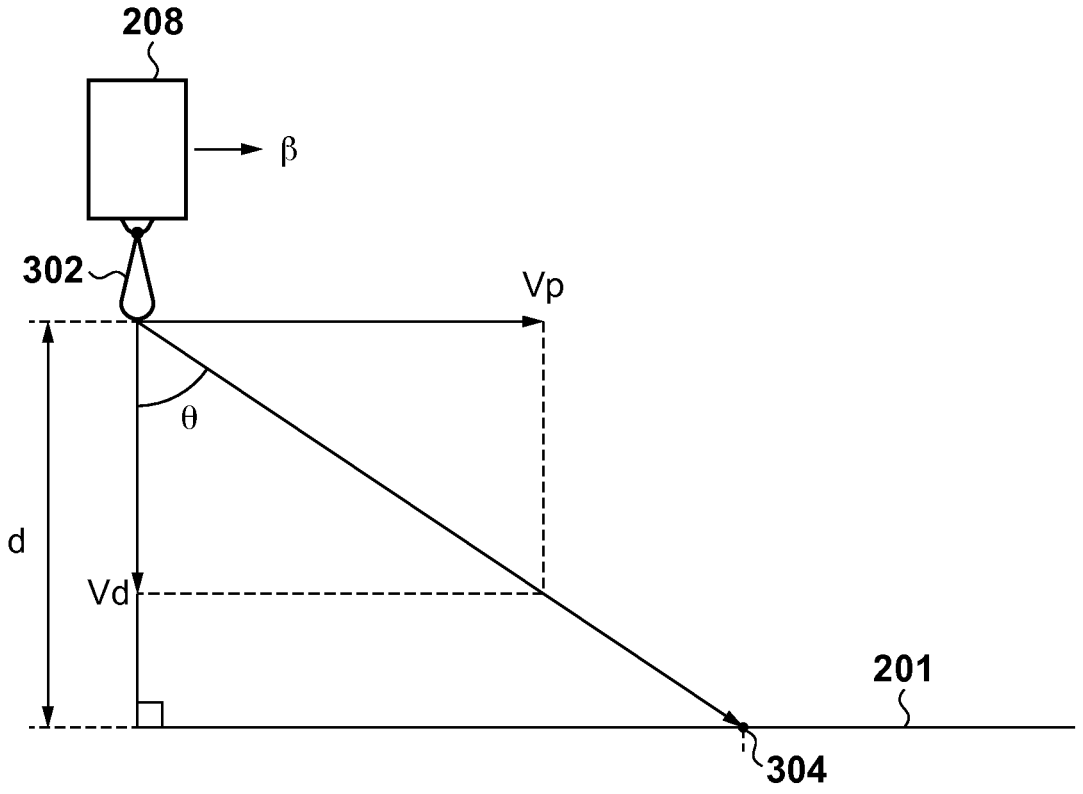
FIG. 3 is a view for explaining the relationship between the moving velocity of a printhead and the landing position of an ink droplet on a print medium.

FIG. 3 is a view for explaining the relationship between the moving velocity of the printhead 208 and the landing position of an ink droplet on the print medium 201. In this case, assume that the carriage 205 on which the printhead 208 is mounted moves in the direction β (main scanning direction) at a scanning velocity Vp.

Assume that an ink droplet 302 is discharged from the ink discharge surface of the printhead 208 toward the printing medium 201 at a discharged velocity Vd that is estimated from a design of the printhead 208. In this case, the ink droplet 302 flies by a vector obtained by combining the scanning velocity Vp and the discharged velocity Vd. The ink droplet 302 flies a distance d between the printing medium 201 and the ink discharge surface of the printhead 208 and lands on the printing medium 201 at a position 304.

Figure 4:
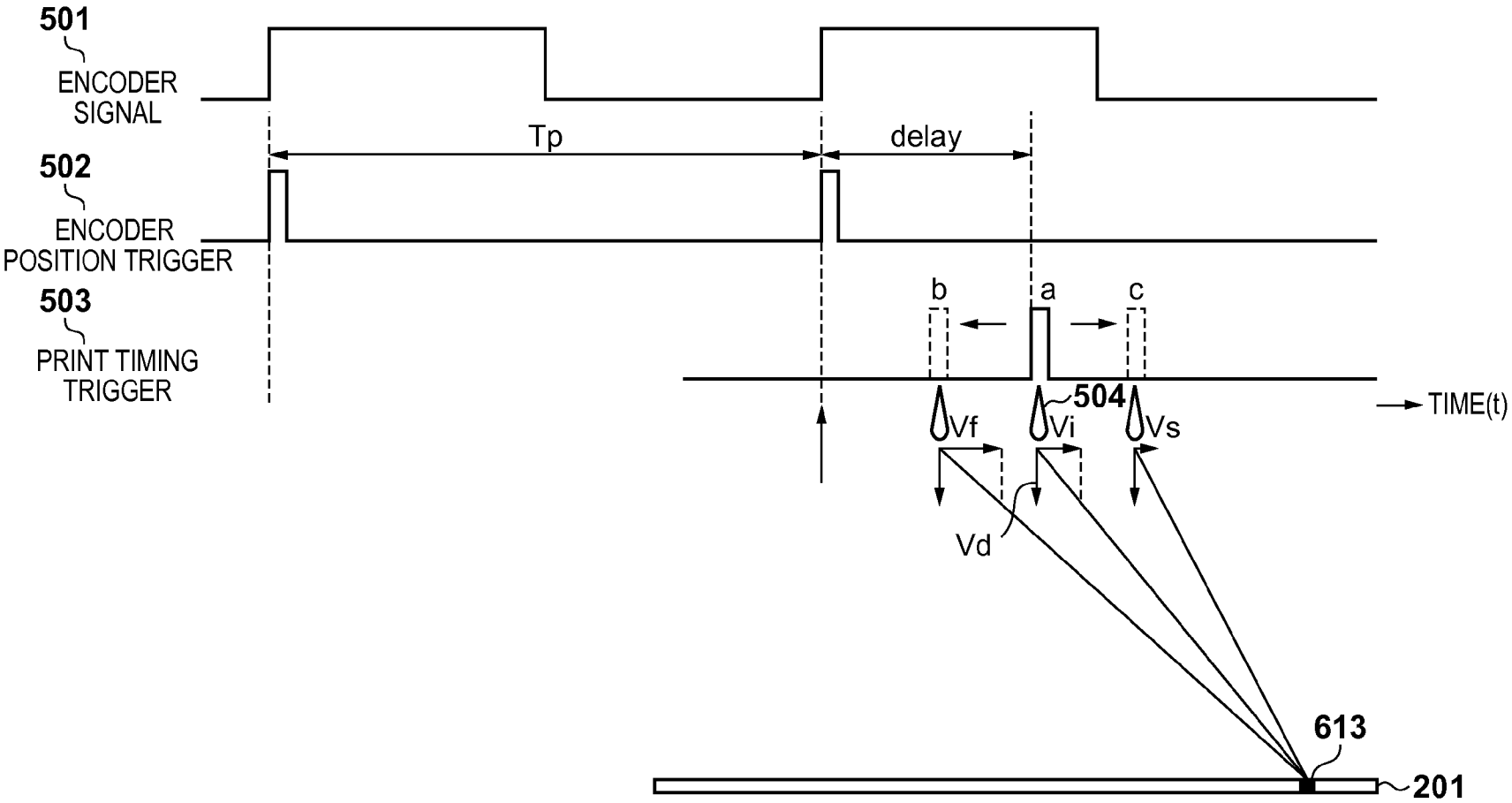
FIG. 4 is a view for explaining correction of the ink droplet landing position by print timing adjustment.

FIG. 4 is a view for explaining correction of the ink droplet landing position by print timing adjustment.

As shown in FIG. 4, an encoder position trigger 502 for a printhead position management signal is generated based on an encoder signal 501. For high-resolution printing, a trigger having a ½ or ¼ period of the encoder period is generated to print. For example, the resolution is 600 dpi at a ½ period of the period of an encoder signal of 150 dpi, or 1,200 dpi at a ¼ period. A description will be made here assuming that an image is printed at the resolution of the encoder signal 501 for the sake of simplicity.

That is, the number of encoder position triggers 502 matches that of print timing triggers 503. As described above, an ink droplet 504 flies in the direction of the resultant vector of the scanning velocity of the printhead (carriage) and the discharged velocity of the ink droplet.

Letting Vi be the ideal scanning velocity of the printhead (carriage), and Vd be the discharged velocity of the ink droplet, a print trigger a is assumed to be generated with a delay from the encoder position trigger 502. If the scanning velocity of the printhead (carriage) is Vf that is higher than the ideal scanning velocity Vi, the delay becomes smaller by calculation. That is, a print trigger b is generated at a timing earlier than the print trigger a for the ideal scanning velocity. Similarly, if the scanning velocity of the printhead (carriage) is Vs that is lower than the ideal scanning velocity Vi, the delay becomes larger by calculation. In this case, a print trigger c is generated at a timing later than the print trigger a for the ideal scanning velocity. The shift amount necessary for generating the print trigger b or print trigger c relative to the print trigger a is also called the shift amount of the driving timing of the printhead.

The landing position shift of the ink droplet caused by the scanning velocity of the printhead (carriage) is corrected by this control. It is therefore possible to make the ink droplet always land at a position 613 such that the ink droplet reaches when the printhead (carriage) moves at the ideal velocity. The current velocity of the printhead (carriage) is calculated as the reciprocal of a period Tp of the encoder signal immediate before the current position.

Figure 5:
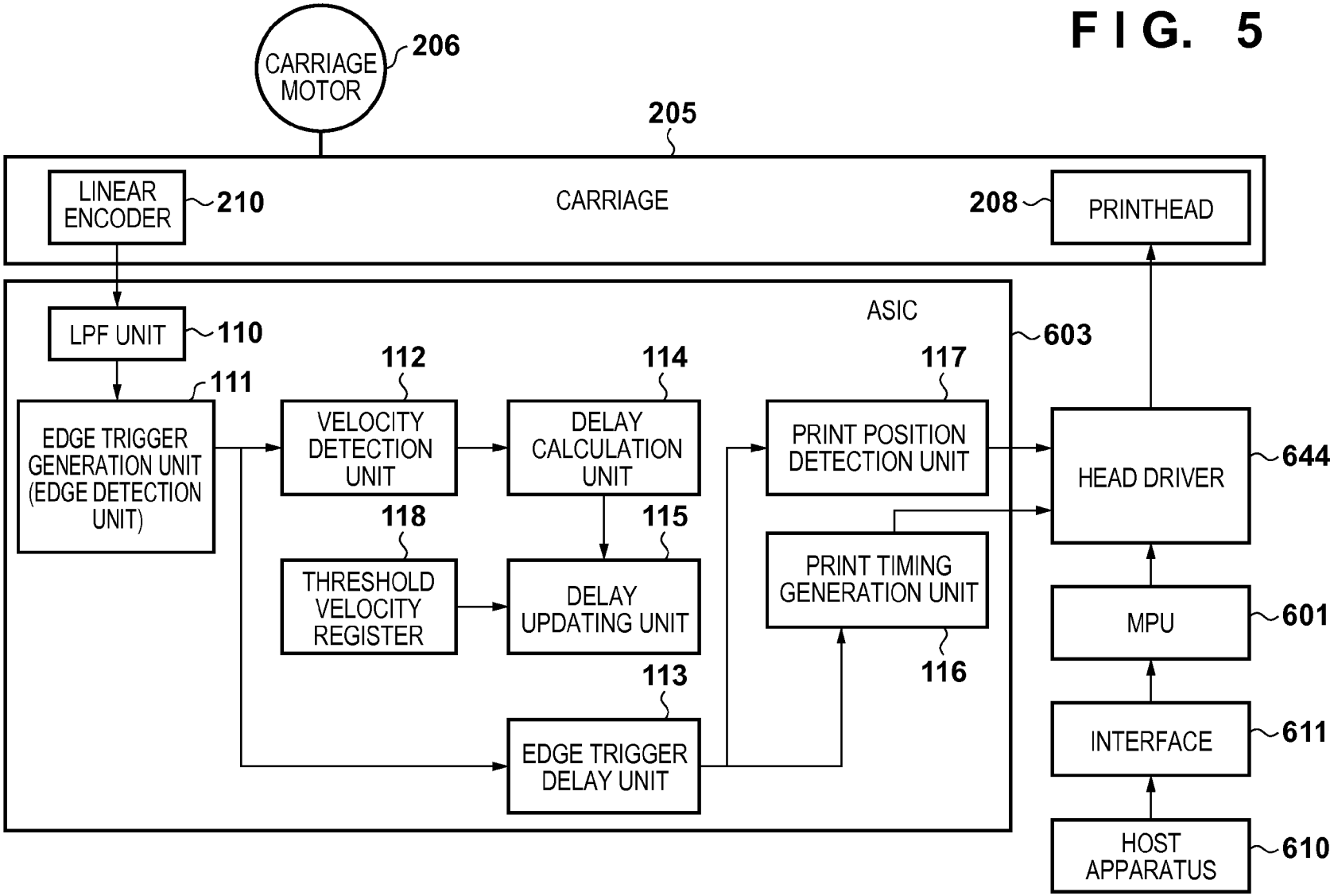
FIG. 5 is a block diagram showing the arrangement of carriage control and print control based on an encoder signal.

FIG. 5 is a block diagram showing the arrangement of carriage control and print control based on the encoder signal. Referring to FIG. 5, the internal arrangement of the ASIC 603 is illustrated as a functional component block to perform carriage control.

The carriage 205 to be driven by the carriage motor 206 includes the printhead 208 mounted thereon and the linear encoder 210 as well. The linear encoder 210 outputs a pulse signal (encoder signal) every time the carriage 205 moves by a predetermined distance. The encoder signal is passed through an LPF unit 110 of the ASIC 603 to filter out noise and then sent to an edge trigger generation unit 111. The edge trigger generation unit 111 detects a predetermined edge (encoder edge) of the received encoder signal and generates a trigger pulse. The trigger pulse generated by the edge trigger generation unit 111 is sent to a velocity detection unit 112, an edge trigger delay unit 113, and a position detection unit (not shown) for servo control.

The velocity detection unit 112 measures the interval of the trigger pulses generated by the edge trigger generation unit 111 and transfers the value to a delay calculation unit 114 as velocity information at the present time. The velocity information detected by the velocity detection unit 112 is also sent to a servo controller (not shown) to servo-control the carriage motor 206, as needed.

The delay calculation unit 114 calculates the shift amount of the printhead driving timing to correct the ink droplet landing position to be described later using the velocity information and the like sent from the velocity detection unit 112.

The shift amount of the printhead driving timing described with reference to FIG. 4 is sent to the edge trigger delay unit 113 via a delay updating unit 115. Based on information of a threshold velocity register 118, the delay updating unit 115 determines whether to hold the shift amount of the printhead driving timing to be sent to the edge trigger delay unit 113 or update it to the calculation result by the current velocity. The edge trigger delay unit 113 delays the trigger pulse generated by the edge trigger generation unit 111 in accordance with the driving timing shift amount received via the delay updating unit 115, and outputs the trigger pulse to a print timing generation unit 116 and a print position detection unit 117.

The print timing generation unit 116 generates a print timing signal by converting the trigger pulse sent from the edge trigger delay unit 113 into a print resolution and sends it to the head driver 644. On the other hand, the print position detection unit 117 generates position information concerning the print timing by counting signals sent from the edge trigger delay unit 113, and sends the information of the start and end of print to the head driver 644.

The head driver 644 transfers print data generated by the MPU 601 to the printhead 208 based on the information from the print timing generation unit 116 and the print position detection unit 117. The printhead 208 drives the printing elements and discharges ink droplets to the print medium based on the print signal and the print timing signal sent from the head driver 644.

Figure 6:
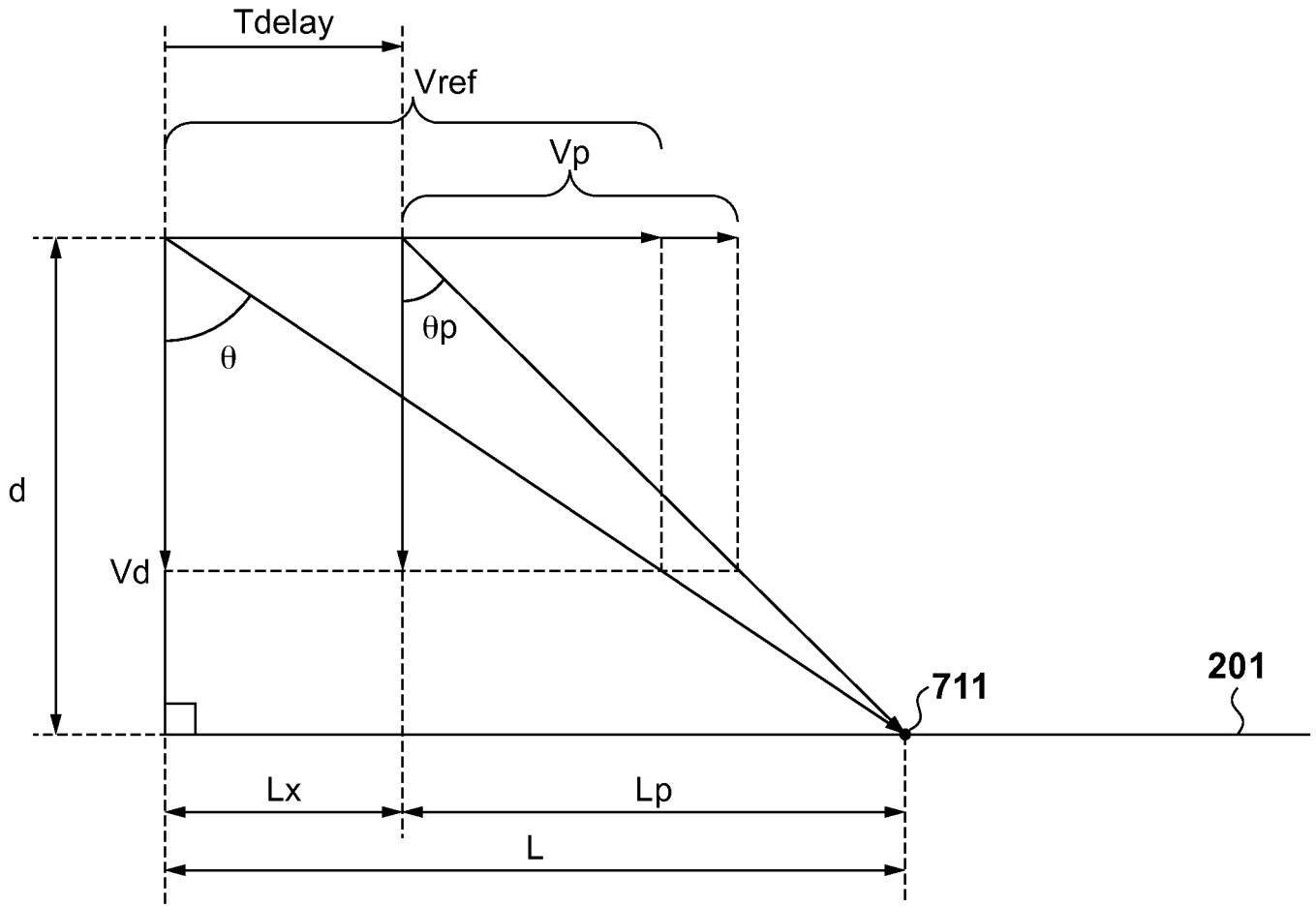
FIG. 6 is a view for explaining a correction value in a case where the scanning velocity of the carriage changes.

FIG. 6 is a view for explaining a correction value (correction amount) in a case where the scanning velocity of the carriage (printhead) changes. Let Vref be the reference velocity of the carriage, Vp be the current scanning velocity, Vd be the discharged velocity of ink, and d be the distance between the printhead and the print medium. Additionally, let θ be the angle at which the ink droplet flies when the scanning velocity of the carriage is the reference velocity Vref, and L be the distance in the main scanning direction from the ink discharge point to the ink landing point on the printing medium at that time. Also let θp be the angle at which the ink droplet flies at the current scanning velocity Vp, and Lp be the distance in the printhead scanning direction from the ink discharge point to the ink landing point on the printing medium at that time.

Then, we have $$L=d*V\mathrm{ref}/Vd \quad (1)$$

$$\text{from } \tan\theta=V\mathrm{ref}/Vd=L/d$$

$$Lp=d*Vp/Vd \quad (2)$$

$$\text{from } \tan\theta p=Vp/Vd=Lp/d$$

Based on equations (1) and (2), a difference Lx in the distance from the ink discharge point to the ink landing point when the printhead moves at each velocity is given by $$Lx=L-Lp=(V\mathrm{ref}-Vp)*d/Vd \quad (3)$$

The scanning velocity of the carriage (printhead) is obtained by the edge interval of the encoder signal, that is, the time to move the distance corresponding to the encoder resolution. Let E be the distance corresponding to the encoder resolution, Tref be the time to move the distance E at the velocity Vref, and Tp be the time to move the distance E at the velocity Vp. In this case, we have $$V\mathrm{ref}=E/T\mathrm{ref} \quad (4)$$

$$Vp=E/Tp \quad (5)$$

In addition, letting Td be the time necessary for the ink droplet to move the distance d at the velocity Vd, we have $$Vd=d/Td \quad (6)$$

Hence, from equations (3) to (6), a time Tdelay necessary to move Lx at the current scanning velocity Vp is given by $$T\mathrm{delay}=Lx/Vp=(Tp-T)*Td/T\mathrm{ref} \quad (7)$$

In this case, when A=Td/Tref, $$T\mathrm{delay}=(Tp-T\mathrm{ref})*A \quad (8)$$

As is apparent from FIG. 6, if the ink discharge point at the current scanning velocity Vp is shifted by the time Tdelay, the landing position at the current scanning velocity Vp can be made to match a landing position 711 at the reference velocity Vref.

That is, from equation (8), if the discharged velocity Vd of the ink droplet and the reference velocity Vref of the printhead are known, the landing position can be corrected every time the current scanning velocity Vp is detected.

Figure 7:
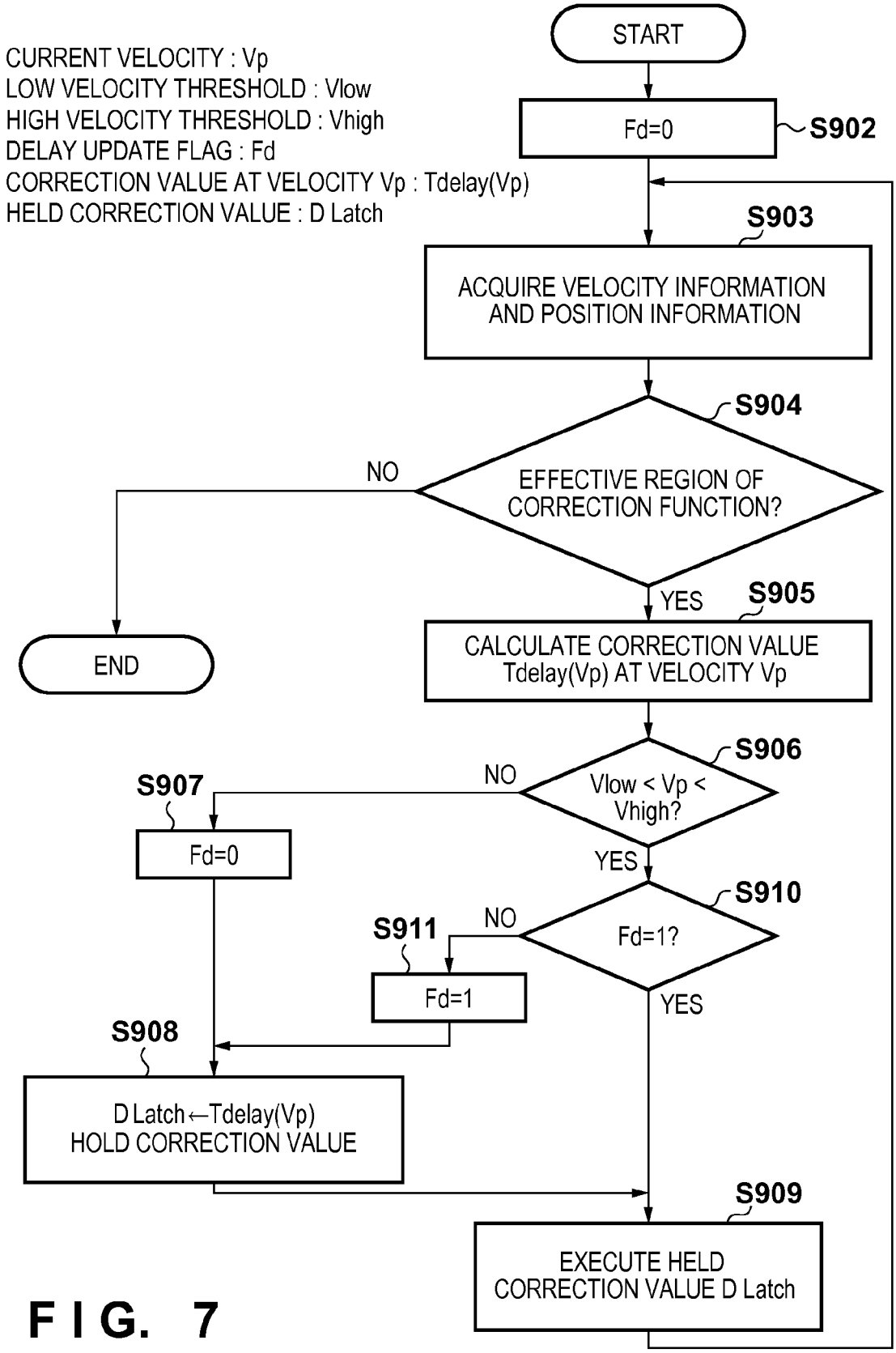
FIG. 7 is a flowchart for explaining a print control operation based on the encoder signal.

FIG. 7 is a flowchart for explaining a print control operation based on the encoder signal. A description will be made here assuming that updating of the correction value (correction amount) is suppressed from the timing at which a velocity between two velocity thresholds is detected continuously twice for the sake of simplicity. Note that the count is not limited to 2, and any other appropriate count such as 3 or more is applicable.

When printhead scanning starts for print, "0" is set in a delay update flag Fd as the initial value in step S902. Every time the edge of the encoder signal is detected, velocity information and position information are acquired in step S903. After that, in step S904, it is determined whether the velocity or position of the carriage falls within the effective region of the landing correction function. Upon determining that the velocity or position of the carriage falls within the range of the effective region of the correction function, the process advances to step S905. Upon determining that the velocity or position of the carriage falls outside the range of the effective region of the correction function, the processing ends.

In step S905, a correction value Tdelay (Vp) for the current scanning velocity Vp is acquired by calculation. In step S906, it is checked whether or not the current scanning velocity Vp is the velocity between a preset low velocity threshold Vlow and a preset high velocity threshold Vhigh. If Vp≥Vhigh or Vp≤Vlow, that is, if the current scanning velocity Vp does not fall between the two velocity thresholds, the process advances to step S907 to reset the delay update flag Fd to the initial value "0". Additionally, in step S908, a correction value calculated by a data latch circuit DLatch is held. After that, in step S909, the print timing is corrected using the held correction value, and printing is performed. The process then returns to step S903 to wait for the velocity information and position information acquisition timing by input of the next encoder signal.

On the other hand, if the current scanning velocity Vp satisfies a relationship Vlow<Vp<Vhigh and is determined to fall between the two velocity thresholds, the process advances to step S910 to check the value of the delay update flag Fd. If Fd≠1, the process advances to step S911 to set the delay update flag Fd to "1", and steps S908 and S909 described above are executed. If Fd=1, the process advances to step S909 to correct the print timing using the previously held correction value and perform printing without holding the calculated correction value by DLatch.

In a case where the value of the delay update flag Fd is judged, and the current scanning velocity Vp falls between the two velocity thresholds twice consecutively, updating of the landing correction value is suppressed.

The above-described processing is executed. In a case where the carriage position falls outside the effective region of the correction function, the processing ends.

Figure 8:
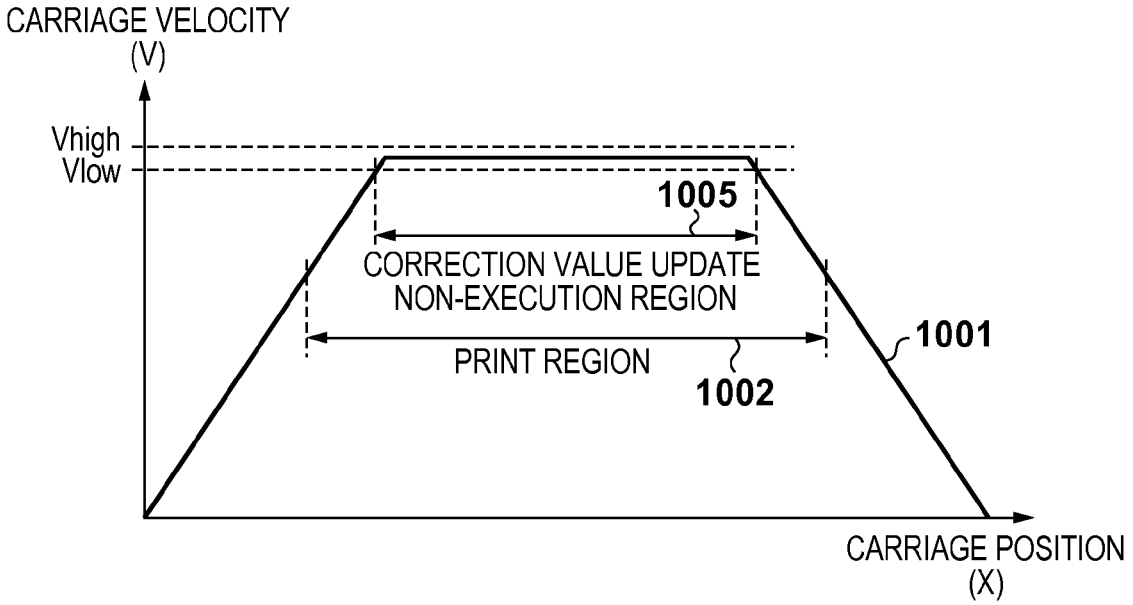
FIG. 8 is a graph showing the relationship between the velocity profile of the carriage and a preset low velocity threshold Vlow and high velocity threshold Vhigh.

FIG. 8 is a graph showing the relationship between the velocity profile of the carriage (printhead) and the preset low velocity threshold Vlow and preset high velocity threshold Vhigh. Referring to FIG. 8, the ordinate represents the carriage velocity (V), and the abscissa represents the position (X) of the carriage (printhead). The origin of the carriage position (X) is assumed to be the home position of the carriage.

As shown in FIG. 8, a velocity profile 1001 of the carriage (printhead) represents that the carriage gradually accelerates from the stop state (V=0) and enters a constant velocity control region where the velocity is stable. After that, the carriage gradually decelerates and stops, thus ending one scanning of the carriage. Note that due to the recent speedup of printing and downsizing of the printing apparatus, a print region 1002 extends from part of the acceleration region of the carriage (printhead) to part of the deceleration region before the end of printing.

The low velocity threshold Vlow and the high velocity threshold Vhigh are set so as to sandwich the constant velocity at which the velocity of the carriage (printhead) is stable. In this case, control is performed not to update the landing correction value during a period 1005 including the constant velocity region where the velocity is stable.

Hence, according to the above-described embodiment, it is possible to execute optimum landing correction in the region where the velocity change is large and suppress updating of the correction value in the constant velocity region where the velocity is stable. In addition, the correction value can be updated when the scanning velocity of the carriage (printhead) has become equal to or more than the high velocity threshold Vhigh or equal to or less than the low velocity threshold Vlow due to overshoot at the end of acceleration or an external disturbance in the constant velocity mode.

Note that for print timing correction in the constant velocity region where the carriage velocity is stable, not only the above-described embodiment, but the following embodiment is also applicable.

Figure 9:
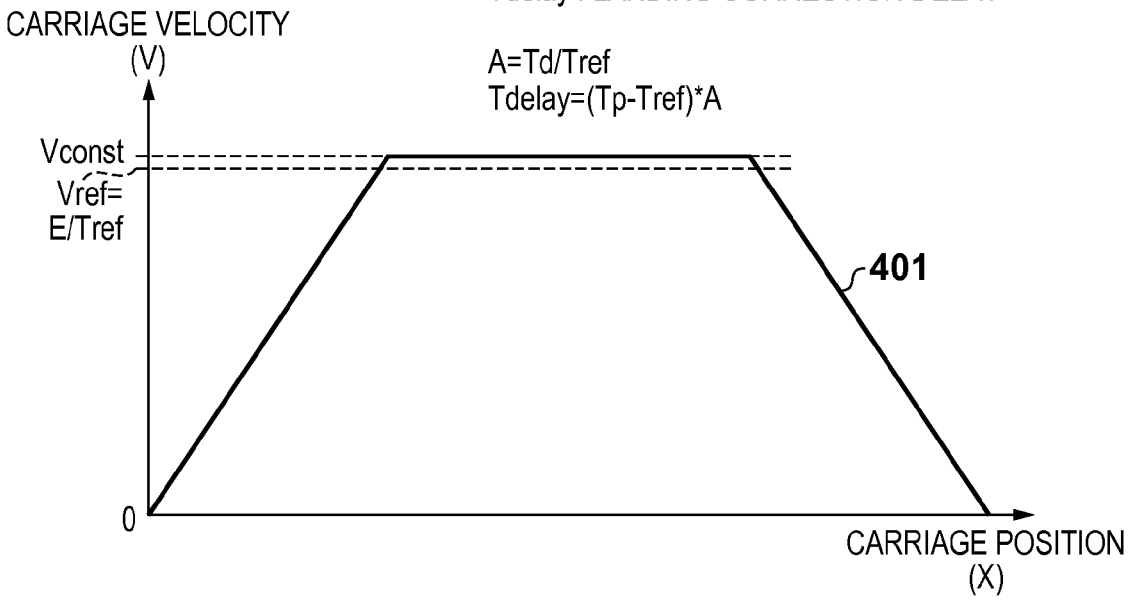
FIG. 9 is a graph showing the relationship between a carriage velocity profile and a reference velocity according to another embodiment.

FIG. 9 is a graph showing the relationship between the velocity profile of the carriage (printhead) and the reference velocity Vref=E/Tref according to another embodiment. Referring to FIG. 9, the ordinate represents a carriage velocity (V), and the abscissa represents a position (X) of the carriage (printhead). The origin of the carriage position (X) is assumed to be the home position of the carriage.

A velocity profile 401 of the carriage (printhead) represents that the carriage gradually accelerates from the stop state (V=0) and enters a constant velocity control region where the velocity is stable, as in FIG. 8. After that, the carriage gradually decelerates and stops, thus ending one scanning of the carriage.

A landing correction value Tdelay is calculated according to equation (8). As can be seen from equation (8), the correction value becomes small as a current scanning velocity Vp approaches the reference velocity Vref, and the correction value Tdelay=0 at Vp=Vref.

In this embodiment, a reference velocity (Vref=E/Tref) slightly lower than a constant velocity Vconst of the velocity profile 401 is set. In a case where the reference velocity is set in this way, equation (8) yields a negative calculation result in the carriage constant velocity region.

Figure 10:
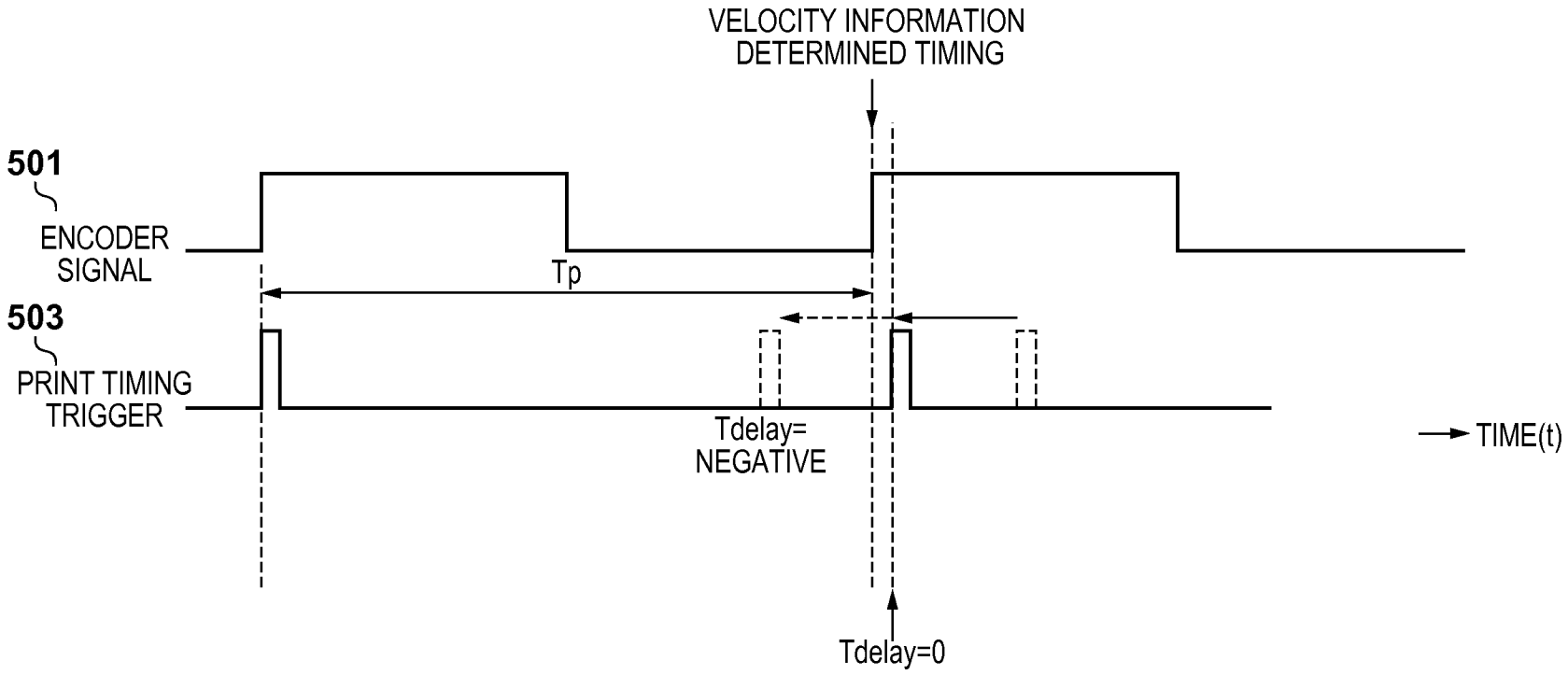
FIG. 10 is a timing chart showing the relationship between an encoder signal and a print timing trigger in a case where the calculation result of equation (8) is negative.
Figure 11:
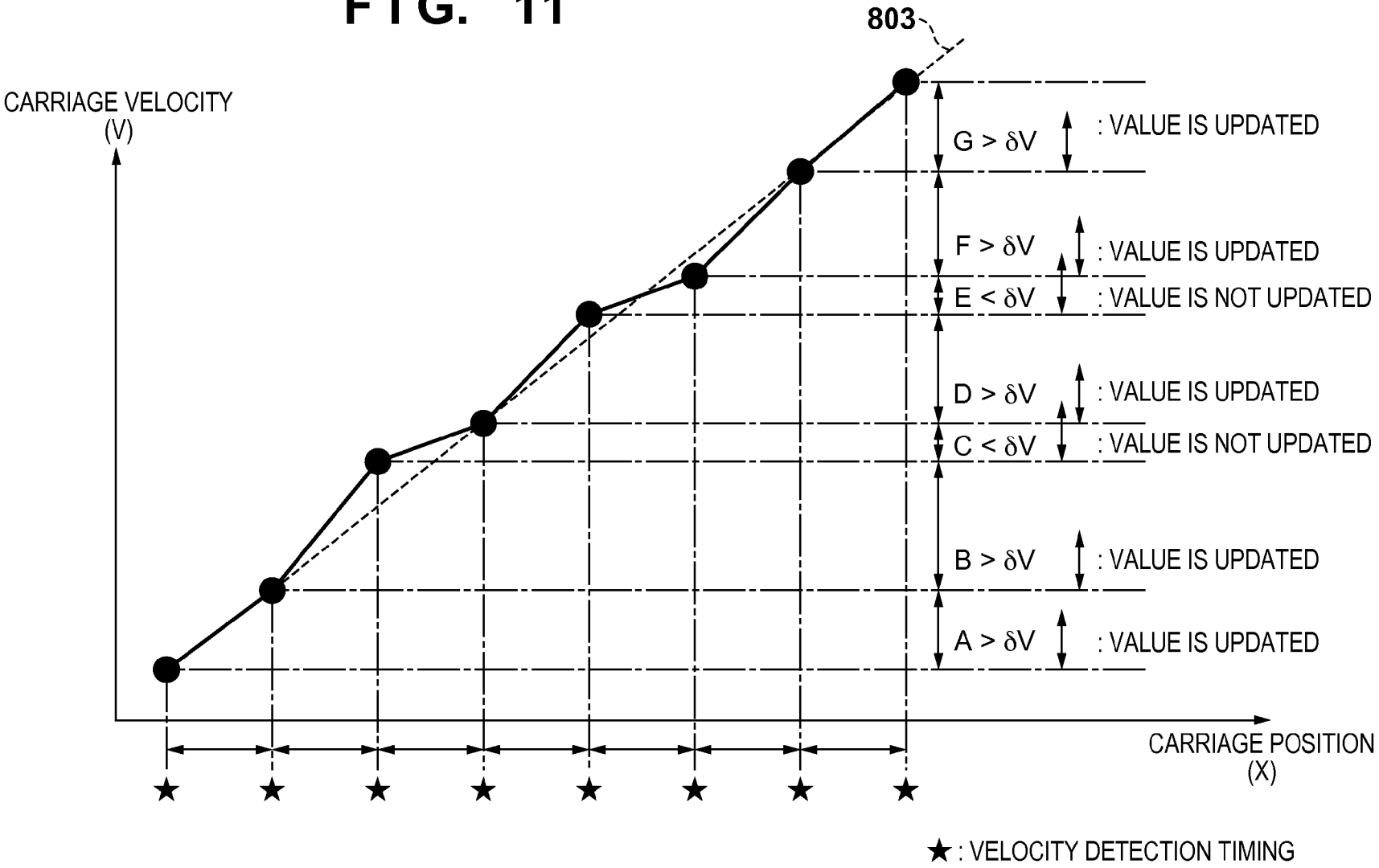
FIG. 11 is a graph for explaining a velocity information acquisition during carriage acceleration.

FIG. 10 is a timing chart showing the relationship between an encoder signal and a print timing trigger in a case where the calculation result of equation (8) is negative.

According to FIG. 10, the end (t=Tp) of one period of an encoder signal 501 corresponds to the velocity information determined timing. Acquisition or calculation of velocity information starts from the velocity information determined timing. At the timing at which the calculation result is obtained, the correction value Tdelay=0.

In a case where a reference velocity (Vref=E/Tref) slightly lower than the constant velocity Vconst of the velocity profile described with reference to FIG. 9 is set, and a negative calculation result is obtained by equation (8), the timing Tdelay before the velocity information determined timing exhibits a negative value. This is a timing before the velocity information determined timing necessary for the calculation, which is physically impossible. That is, the correction value Tdelay=0 is the minimum set value in the actual operation. Hence, in this embodiment, in a case where the calculation result is "0" or less, the correction value Tdelay is fixed at 0, and Tdelay=0 is output.

Hence, in a case where a reference velocity (Vref=E/Tref) slightly lower than the constant velocity Vconst of the velocity profile described with reference to FIG. 9 is set, and the carriage scanning velocity becomes equal to or higher than the reference velocity, correction value Tdelay=0 is obtained. This realizes control in which updating of the correction value is suppressed to a minimum degree in the constant velocity region (a region where the velocity is equal to or higher than the reference velocity Vref).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-276116, filed Dec. 18, 2012, which is hereby incorporated by reference herein in its entirety.

What is claimed is:

1. A printing apparatus that discharges ink from a printhead to a print medium while reciprocally scanning a carriage on which the printhead is mounted, thereby printing in part of a region where the scanning accelerates, in a region where the carriage moves in a predetermined velocity, and in part of a region where the scanning decelerates, comprising:

a detection unit configured to detect a scanning velocity of the carriage; and an adjustment unit configured to adjust a print timing by the printhead based on the scanning velocity and a distance between the printhead and the print medium, wherein said adjustment unit suppresses adjustment of the print timing in a case where the scanning velocity detected by said detection unit falls within a predetermined range in a region which is narrower than that for the printing and includes the region where the scanning accelerates, the region where the carriage moves in the predetermined velocity, and the region where the scanning decelerates.

2. The apparatus according to claim 1, wherein said detection unit includes:

a linear scale provided along a direction in which the carriage is scanned; and an encoder provided on the carriage and configured to read a slit provided on said linear scale as the carriage is scanned, and said detection unit detects the scanning velocity of the carriage based on a signal output from said encoder.

3. The apparatus according to claim 2, further comprising an acquisition unit configured to acquire a correction amount of the print timing by the printhead based on the scanning velocity, an estimated discharged velocity of the ink from the printhead, and the distance between the printhead and the print medium, wherein said adjustment unit adjusts the print timing by the printhead based on the correction amount acquired by said acquisition unit.

4. The apparatus according to claim 1, wherein said adjustment unit includes a comparison unit configured to compare the scanning velocity detected by said detection unit with an upper limit and a lower limit of the predetermined velocity range.

5. The apparatus according to claim 4, wherein the predetermined velocity range sandwiches a stable scanning velocity of the carriage, and a high velocity threshold is defined as the upper limit, and a low velocity threshold is defined as the lower limit.

6. The apparatus according to claim 5, wherein said adjustment unit includes a counting unit configured to count, based on a comparison result of said comparison unit, a number of times where the scanning velocity detected by said detection unit consecutively falls between the high velocity threshold and the low velocity threshold.

7. The apparatus according to claim 6, wherein said adjustment unit suppresses adjustment of the print timing upon determining, based on the number of times counted by said counting unit, that the scanning velocity has consecutively fallen between the high velocity threshold and the low velocity threshold at least a predetermined number of times.

8. The apparatus according to claim 3, wherein said acquisition unit acquires the correction amount every time the encoder outputs the signal in accordance with movement of the carriage.

9. The apparatus according to claim 8, wherein letting Tp be a period of the signal of the encoder, Tref be a period of the signal when the carriage is scanned at a reference velocity, and Td be a time necessary for an ink droplet to be discharged from the printhead and fly a distance between the printing medium and an ink discharge surface of the printhead, said acquisition unit acquires the correction amount Tdelay of the print timing of the printhead, which is given by $$T\text{delay}=(Tp-T\text{ref})*A,$$

$$A=Td/T\text{ref}.$$

10. The apparatus according to claim 9, wherein a velocity slightly lower than a stable scanning velocity of the carriage is set as the reference velocity, and in a case where the correction amount of the print timing obtained as a result of acquisition of said acquisition unit is not more than "0", the correction amount of the print timing of the printhead is set to "0".

11. A print control method of discharging ink from a printhead to a print medium while scanning a carriage on which the printhead is mounted, thereby printing in part of a region where the scanning accelerates, in a region where the carriage moves in a predetermined velocity, and in part of a region where the scanning decelerates, comprising:

detecting a scanning velocity of the carriage; and adjusting a print timing by the printhead based on the scanning velocity, and a distance between the printhead and the print medium, wherein adjustment of the print timing is suppressed in a case where the detected scanning velocity falls within a predetermined range in a region which is narrower than that for the printing and includes the region where the scanning accelerates, the region where the carriage moves in the predetermined velocity, and the region where the scanning decelerates.

12. The method according to claim 11, wherein the scanning velocity is detected based on a signal that is output, in accordance with the scanning of the carriage, from an encoder provided on the carriage upon reading a slit provided on a linear scale provided along a direction in which the carriage is scanned.

13. The method according to claim 11, further comprising acquiring a correction amount of the print timing by the printhead based on the scanning velocity, an estimated discharged velocity of the ink from the printhead, and the distance between the printhead and the print medium.

14. The method according to claim 13, wherein the print timing by the printhead is adjusted based on the acquired correction amount of the print timing.

* * * * *